US011500320B2

(12) United States Patent
Kikuchi

(10) Patent No.: US 11,500,320 B2
(45) Date of Patent: Nov. 15, 2022

(54) IMAGE FORMING DEVICE

(71) Applicant: Konica Minolta, Inc., Tokyo (JP)

(72) Inventor: Toru Kikuchi, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 17/321,375

(22) Filed: May 14, 2021

(65) Prior Publication Data

US 2021/0389710 A1 Dec. 16, 2021

(30) Foreign Application Priority Data

Jun. 12, 2020 (JP) ..... JP2020-101954

(51) Int. Cl.
*G03G 15/00* (2006.01)
*G03G 15/16* (2006.01)

(52) U.S. Cl.
CPC ..... *G03G 15/657* (2013.01); *G03G 15/167* (2013.01); *G03G 15/5029* (2013.01); *G03G 15/5062* (2013.01); *G03G 15/6529* (2013.01)

(58) Field of Classification Search
CPC ..... G03G 15/657; G03G 15/5029; G03G 2215/1623; G03G 15/1615; G03G 15/167; G03G 2215/00738
See application file for complete search history.

(56) References Cited

U.S. PATENT DOCUMENTS 9,678,459 B2 * 6/2017 Suzuki ..... G03G 15/1685
2006/0222394 A1 * 10/2006 Koshida ..... G03G 15/657 399/68
2008/0019717 A1 * 1/2008 Soshiroda ..... G03G 15/161 399/45
2009/0003895 A1 * 1/2009 Yamauchi ..... G03G 15/1675 399/313
2009/0279906 A1 * 11/2009 Kuma ..... B65H 5/062 399/388
2011/0249993 A1 * 10/2011 Nakamura ..... G03G 15/1685 399/302
2012/0269531 A1 * 10/2012 Suzuki ..... G03G 15/657 399/67
2015/0286166 A1 * 10/2015 Kokubo ..... G03G 15/1605 399/313
2019/0079433 A1 * 3/2019 Watanabe ..... G03G 15/5029

FOREIGN PATENT DOCUMENTS

JP 2011-253019 A 12/2011
JP 2019-86586 A 6/2019

* cited by examiner

*Primary Examiner* — Jessica L Eley
(74) *Attorney, Agent, or Firm* — Squire Patton Boggs (US) LLP

(57) ABSTRACT

An image forming device includes an image carrier, a transfer member, a fixing device, a conveyance member, and a controller. The transfer member forms a transfer nip that transfers an image carried on the image carrier to a recording medium. The fixing device fixes the image on the recording medium. The conveyance member is located downstream of the transfer member in a conveyance direction of the recording medium and feeds the recording medium to the fixing device. The controller variably controls position of the conveyance member.

8 Claims, 5 Drawing Sheets

| ENVIRONMENT 2 | | | | |
|---|---|---|---|---|
| POSITION OF SECONDARY TRANSFER CONVEYANCE ROLLERS | LESS THAN 100% COVERAGE | | 100% OR MORE COVERAGE | |
| WEIGHT(g/m$^2$) | SIDE 1 | SIDE 2 | SIDE 1 | SIDE 2 |
| – 120 | H1 | H1 | H1 | H1 |
| 121 – 220 | H1 | H2 | H2 | H2 |
| 221 – | H3 | H3 | H3 | H3 |

| ENVIRONMENT 2 | | | | |
|---|---|---|---|---|
| POSITION OF SECONDARY TRANSFER CONVEYANCE ROLLERS | LESS THAN 100% COVERAGE | | 100% OR MORE COVERAGE | |
| BENDING STIFFNESS(mN) | SIDE 1 | SIDE 2 | SIDE 1 | SIDE 2 |
| – 20 | H1 | H1 | H1 | H2 |
| 21 – 100 | H2 | H2 | H2 | H3 |
| 101 – | H3 | H3 | H3 | H3 |

| ENVIRONMENT 1 | | | | | |
|---|---|---|---|---|---|
| POSITION OF SECONDARY TRANSFER CONVEYANCE ROLLERS | | LESS THAN 100% COVERAGE | | 100% OR MORE COVERAGE | |
| | | SIDE 1 | SIDE 2 | SIDE 1 | SIDE 2 |
| WEIGHT ($g/m^2$) | − 120 | H1 | H1 | H1 | H1 |
| | 121 − 220 | H2 | H2 | H2 | H3 |
| | 221 − | H3 | H3 | H3 | H3 |
| BENDING STIFFNESS (mN) | − 20 | H1 | H1 | H1 | H1 |
| | 21 − 100 | H2 | H2 | H3 | H3 |
| | 101 − | H3 | H3 | H3 | H3 |

FIG.10
| ENVIRONMENT 3 | | | | | |
|---|---|---|---|---|---|
| POSITION OF SECONDARY TRANSFER CONVEYANCE ROLLERS | | LESS THAN 100% COVERAGE | | 100% OR MORE COVERAGE | |
| | | SIDE 1 | SIDE 2 | SIDE 1 | SIDE 2 |
| WEIGHT ($g/m^2$) | – 120 | H1 | H1 | H1 | H1 |
| | 121 – 220 | H1 | H1 | H2 | H2 |
| | 221 – | H3 | H3 | H3 | H3 |
| BENDING STIFFNESS (mN) | – 20 | H1 | H1 | H1 | H2 |
| | 21 – 100 | H2 | H2 | H2 | H2 |
| | 101 – | H3 | H3 | H3 | H3 |
FIG.11
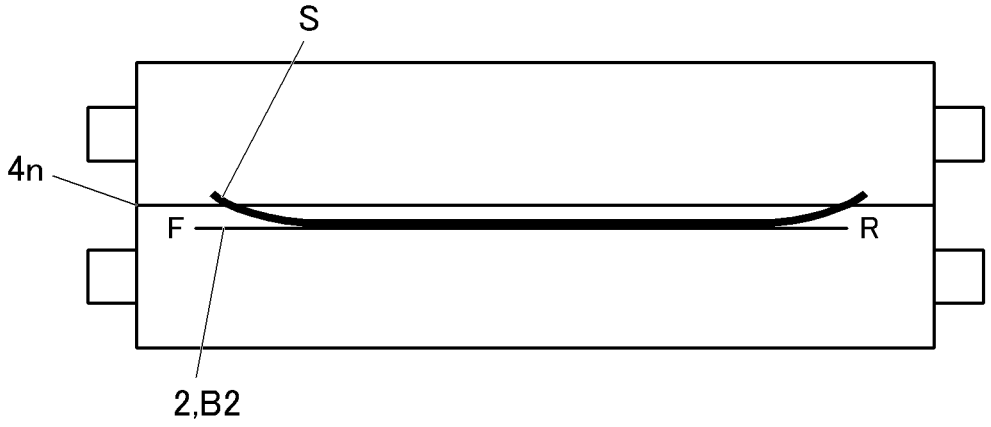
FIG.12
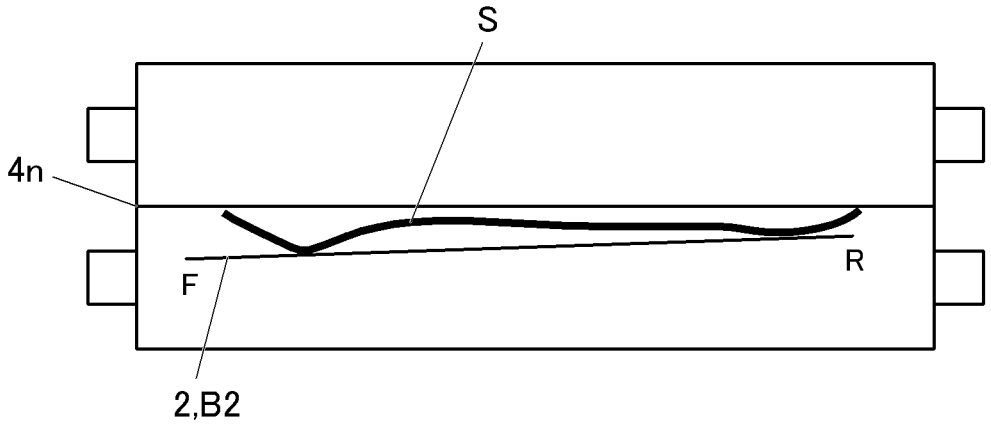

IMAGE FORMING DEVICE

BACKGROUND

1. Technical Field

The present invention relates to an image forming device.

2. Background Art

In an image forming device, a toner image carried on an intermediate transfer belt or the like is transferred to a recording medium. The recording medium is fed into a fixing nip of a fixing device.

At this time, the recording medium is distorted because the recording medium gets into the fixing nip at an angle. The recording medium comes into contact with an upper fixing member (belt, upper guide, etc.), and thereby streak-like wrinkles (blur) are generated at an edge of the recording medium.

According to an invention described in JP 2011-253019A, both sides of paper are passed through a device. A voltage applied to a secondary transfer roller is higher when the second side is passed than when the first side is passed. The secondary transfer roller is moved away from a fixing device to convey the paper. It stabilizes entry into a fixing nip.

According to an invention described in JP 2019-86586A, both sides of paper are passed through a device. An amount of curl is detected when the second side gets into a fixing approach guide. Paper is conveyed while position and shape of the guide are changed according to condition of paper. It stabilizes entry into a fixing nip.

However, position where paper is conveyed to the fixing device becomes unstable depending on stiffness of a recording medium such as thin paper. Sometimes a recording medium diagonally gets into the fixing nip to cause a blur. Even if conveyance position is optimized for a recording medium of a certain stiffness, position where paper is conveyed to the fixing device becomes unstable when a recording medium of different stiffness is conveyed. Sometimes a recording medium diagonally gets into the fixing nip to cause a blur.

SUMMARY OF INVENTION

The present invention was made in view of the above problems in the prior art. An object of the present invention is to maintain good image quality by stably conveying a recording medium to a fixing device in an image forming device without changing transcription of an image to the recording medium.

According to an aspect of the present invention, an image forming device includes:

an image carrier;

a transfer member that forms a transfer nip that transfers an image carried on the image carrier to a recording medium;

a fixing device that fixes the image on the recording medium;

a conveyance member which is located downstream of the transfer member in a conveyance direction of the recording medium and which feeds the recording medium to the fixing device; and a controller, wherein the controller variably controls position of the conveyance member.

BRIEF DESCRIPTION OF DRAWINGS

The advantages and features provided by one or more embodiments of the invention will become more fully understood from the detailed description given hereinbelow and the appended drawings which are given by way of illustration only, and thus are not intended as a definition of the limits of the present invention.

FIG. 10 is a table of correspondence between conditions applied by the controller and height of the conveyance member.

FIG. 11 is a schematic view showing positional relation between a recording medium and the conveyance member and a fixing nip.

FIG. 12 is a schematic view showing positional relation between a recording medium and the conveyance member and the fixing nip.

DESCRIPTION OF EMBODIMENTS

An embodiment of the present invention will be described below with reference to the drawings. The following is one embodiment of the present invention and does not limit the present invention.

The embodiment is an electrophotographic image forming device including configuration described below.

Figure 1:
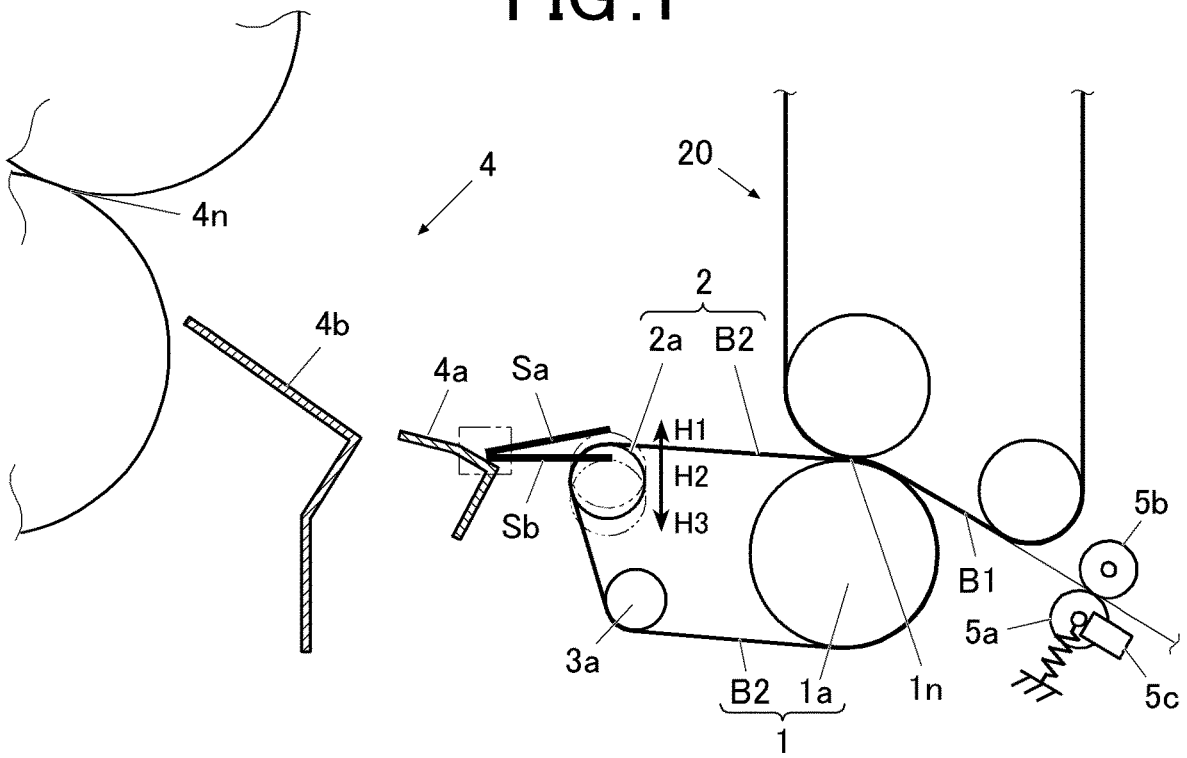
FIG. 1 is a schematic view showing main configuration of a transfer unit for a recording medium and a fixing device.
Figure 2:
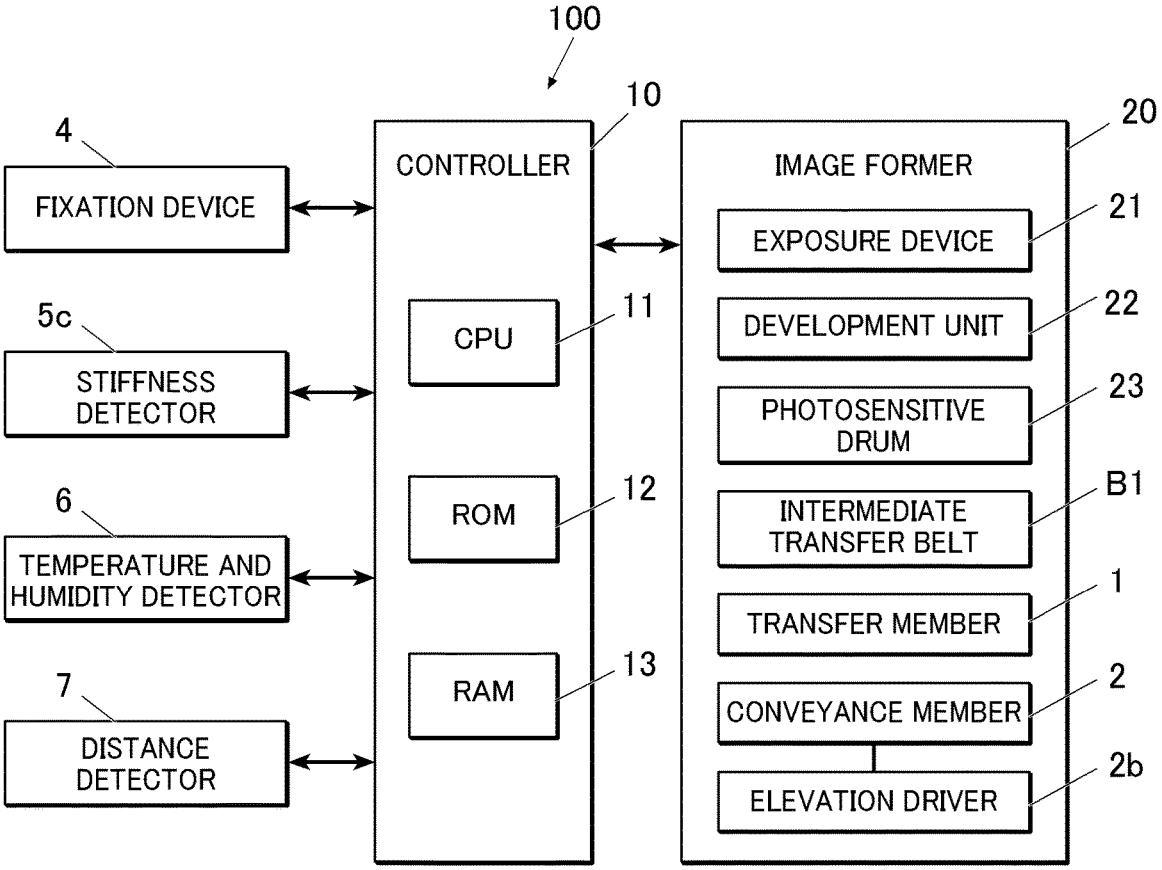
FIG. 2 is a block diagram showing main functional configuration of an image forming device.

FIG. 1 is a schematic view showing main configuration of a transfer unit for a recording medium (paper) and a fixing device in the image forming device of the embodiment. FIG. 2 is a block diagram showing main functional configuration of the image forming device of the embodiment.

The image forming device 100 of the embodiment includes a controller 10, an image former 20, a fixing device 4, a stiffness detector 5*c*, a temperature and humidity detector 6, and a distance detector 7.

The controller 10 of the image forming device 100 controls the entire image forming device 100 including the image former 20 and the fixing device 4.

The controller 10 includes a CPU (central processing unit) 11, ROM (read only memory) 12, and RAM (random access memory) 13. The CPU 11 reads a program corresponding to contents of processing from the ROM 12 and develops it in the RAM 13. The CPU 11 cooperates with the developed program to comprehensively control operation of parts of the image forming device 100.

The electrophotographic image former 20 includes:

an exposure device 21 that draws an electrostatic latent image on a photosensitive drum 23;

a development unit 22 that develops the electrostatic latent image into a toner image;

an intermediate transfer belt B1 as an image carrier on which a toner image is transferred from the photosensitive drum 23;

a transfer member 1 (1*a* and B2) that forms a transfer nip 1*n* that transfers (secondary transfer) the toner image carried on the intermediate transfer belt B1 to a recording medium S (Sa, Sb);

a conveyance member 2 (2*a* and B2) which is located downstream from the transfer member 1 in a conveyance direction of the recording medium S and which feeds the recording medium S to the fixing device 4; and other common configurations such as a charging device and a cleaning device.

The image forming device 100 further includes an image reader, an operation display, an image processor that processes image data, a paper conveyor (including resist rollers 5*a*, 5*b*), a memory, and a communicator.

The transfer member 1 includes a transfer roller 1*a* and a conveyance belt B2 hung on the transfer roller 1*a*. The conveyance member 2 includes a drive roller 2*a* and the conveyance belt B2. The transfer member 1 and the conveyance member 2 share the conveyance belt B2.

The conveyance belt B2 circulates between:

a position where the conveyance belt B2 functions as the transfer member 1; and a position where the conveyance belt B2 functions as the conveyance member 2.

The conveyance belt B2 functions as the transfer member 1 at the transfer nip 1*n*. The conveyance belt B2 functions as the conveyance member 2 in a range between the transfer nip 1*n* and the drive roller 2*a* downstream from the transfer nip 1*n*.

The conveyance belt B2 is wound around the transfer roller 1*a*, the drive roller 2*a*, and a tension pulley 3*a*. The conveyance belt B2 is driven by rotation of the drive roller 2*a*.

The conveyance member 2 is moved up and down by an elevation driver 2*b*. Both ends of a shaft of the drive roller 2*a* are moved up and down together. Alternatively, each end of the shaft of the drive roller 2*a* is moved up and down individually. Thereby an upper surface of the conveyance belt B2 also moves up and down. The upper surface of the conveyance belt B2 is at a position where the conveyance belt B2 functions as the conveyance member 2. In the configuration in which each end of the shaft of the drive roller 2*a* is moved up and down individually, the controller 10 individually controls position (height) of each edge of the conveyance member 2 in a width direction FR of the recording medium S, which is orthogonal to the conveyance direction of the recording medium S.

The controller 10 outputs a control signal to the elevation driver 2*b* to variably control position of the conveyance member 2. In the embodiment, height levels in control are H1, H2, and H3 in descending order as shown in FIG. 1. As described above, displacement of the conveyance member 2 caused by control of the controller 10 includes a component perpendicular to a surface of the recording medium S passing through the conveyance member 2. The displacement is not limited to a vertical displacement. The displacement compensates for variations in separation of the recording medium S from the conveyance member 2. As a result, the displacement keeps conveyance position on the fixing device 4 within a certain range.

As described above, the conveyance member 2 is a rotating member and conveys at least the recording medium S. The conveyance member 2 may be just a conveyance roller, or may be a conveyance belt independent of the transfer member.

Two fixing guide members of the fixing device 4, i.e., a pre-fixing guide 4*a* and a fixing approach guide 4*b*, guide the recording medium S and put the recording medium S into a fixing nip 4*n*. The fixing guide members may be integrated.

The stiffness detector 5*c* is a kind of physical property detector that detects physical properties of the recording medium S. The stiffness detector 5*c* detects stiffness of the recording medium S. For example, the stiffness detector 5*c* is an acceleration sensor. The resist roller 5*a* is supported by a spring as shown in FIG. 1. The acceleration sensor detects vibration of the resist roller 5*a* when the recording medium S collides.

The stiffness detector 5*c* measures stiffness of the recording medium S beginning to be conveyed to the transfer nip 1*n*. Thus, the stiffness detector 5*c* individually detects stiffness of each recording medium S on which an image is formed.

The stiffness detector 5*c* detects stiffness of the recording medium S before the recording medium S reaches the conveyance member 2. Therefore, the controller 10 can control height of the conveyance member 2 before the recording medium S reaches the conveyance member 2.

The temperature and humidity detector 6 detects temperature and humidity of environment around the recording medium S.

Figure 3:
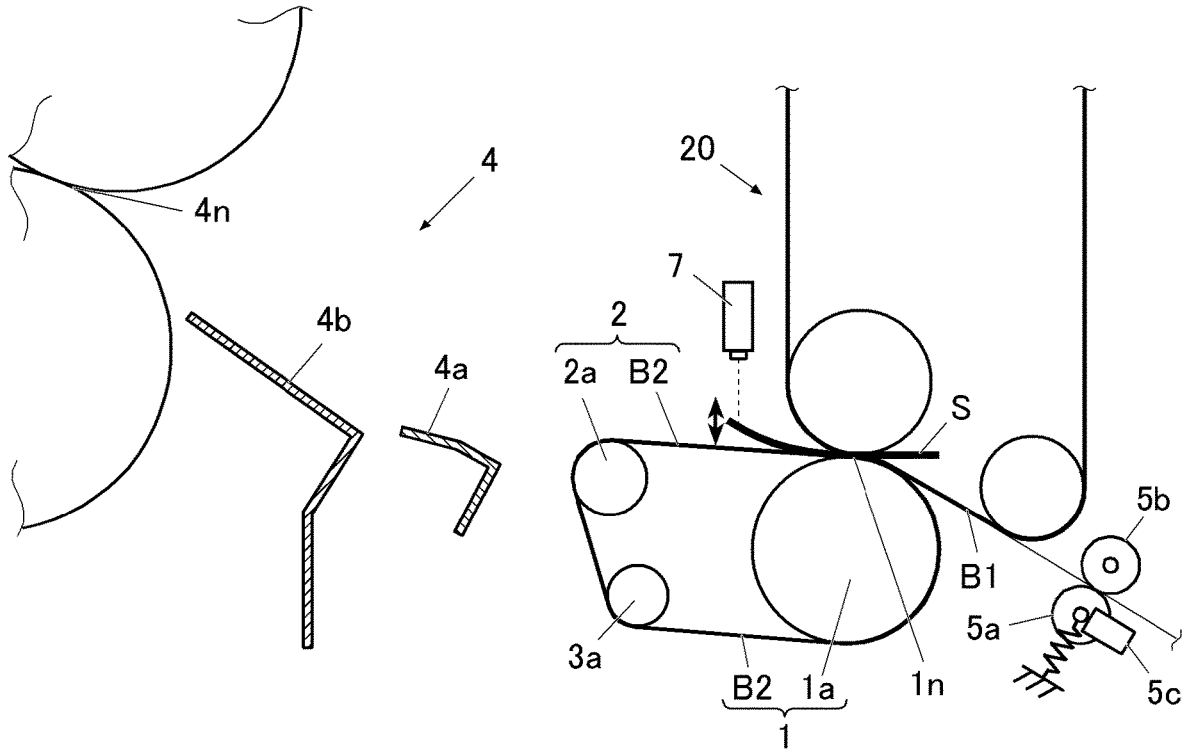
FIG. 3 is a schematic view showing main configuration of the transfer unit for a recording medium and the fixing device for explaining a distance detector.

The distance detector 7 is located upstream of the conveyance member 2 and detects a distance between the recording medium S and the conveyance belt B2. The distance detector 7 is, for example, an optical distance sensor. As shown in FIG. 3, the distance detector 7 detects a distance between the recording medium S and the conveyance belt B2 downstream of the transfer nip 1*n*. A measured value obtained by measuring a surface of the conveyance belt B2 in the absence of the recording medium S may be used as a reference for the distance.

Figure 4:
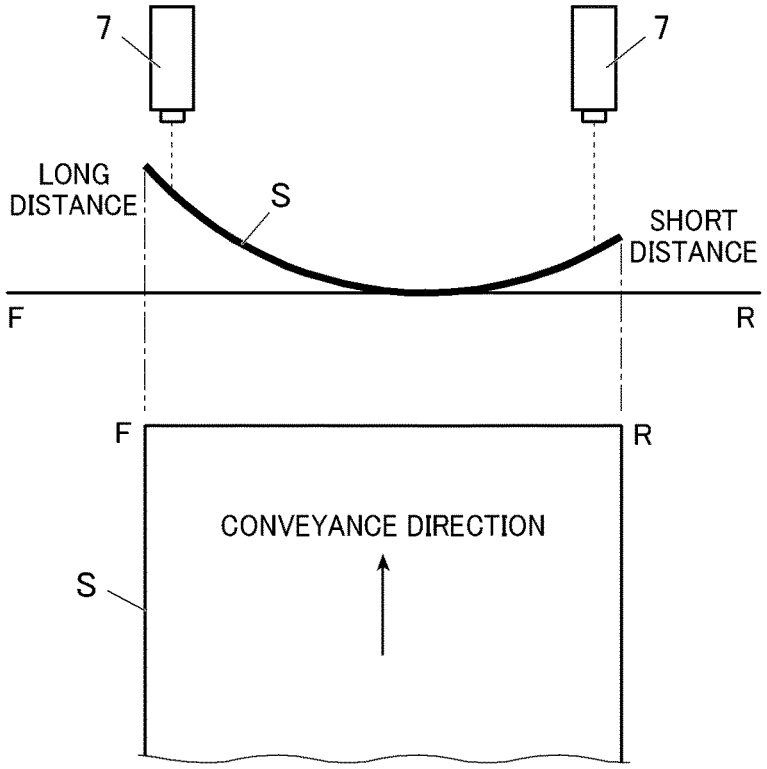
FIG. 4 is a cross-sectional view and a plan view of a recording medium for explaining the distance detector.

As shown in FIG. 4, the distance detector 7 may detect a distance between the recording medium S and the conveyance belt B2 at two or more different positions in the width direction FR of the recording medium S, which is orthogonal to the conveyance direction of the recording medium S. In FIG. 4, distances at two points are measured, but distances at three or more points may be measured.

A flow of operation is as follows.

A tip of the recording medium S hits the resist rollers 5*a*, 5*b*, and the recording medium S temporarily stops. The recording medium S passes through the resist rollers 5*a*, 5*b* to get into the transfer nip 1*n* at the same predetermined time as time of image feed of the intermediate transfer belt B1.

As the recording medium S passes through the transfer nip 1*n*, a toner image carried on the intermediate transfer belt B1 is transferred to the recording medium S.

The recording medium S on which the toner image is transferred is fed to the fixing device 4 by the conveyance member 2. The recording medium S first hits the pre-fixing guide 4*a*. The recording medium S is guided by the pre-fixing guide 4*a* and the fixing approach guide 4*b*, and gets into the fixing nip 4*n*.

Before the recording medium S hits the pre-fixing guide 4*a*, when the recording medium S is fed to the fixing device 4 by the conveyance member 2, the controller 10 controls the conveyance member 2 such that the conveyance member 2 is at an appropriate height. The controller 10 brings the recording medium S into contact with the pre-fixing guide 4*a* at an appropriate angle, and smoothly feeds the recording medium S to the fixing device 4.

Figures 5, 6, 7:
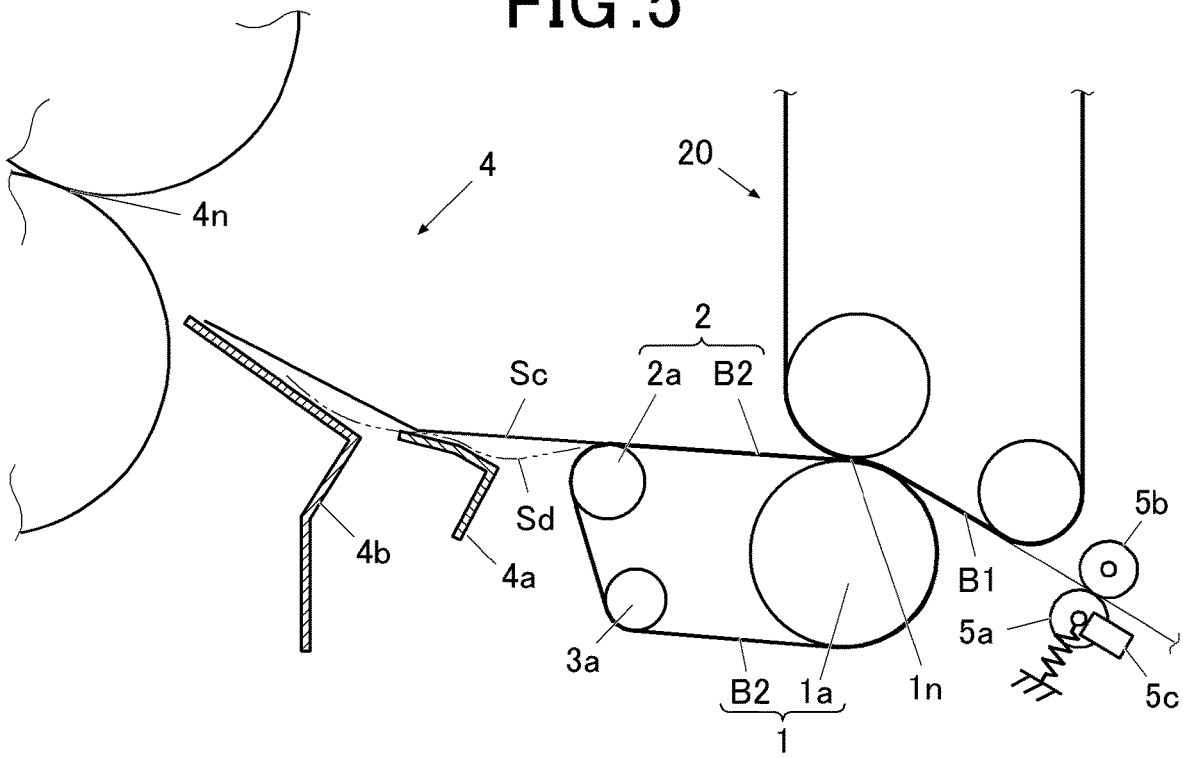
FIG. 5 is a schematic view showing main configuration of the transfer unit for a recording medium and the fixing device for explaining a degree of separation of a recording medium.
FIG. 6 is a table of correspondence between conditions applied by a controller and height of a conveyance member.
FIG. 7 is a table of correspondence between conditions applied by the controller and height of the conveyance member.

As shown in FIG. 5, the recording medium S is separated from the conveyance belt B2 due to curvature of the drive roller 2*a* and stiffness of the recording medium S. Degree of separation depends on stiffness of the recording medium S. Therefore, a point where the recording medium S lands on the pre-fixing guide 4*a* from the conveyance belt B2 varies depending on basis weight and the like. Even if height is adjusted for a recording medium Sc of a certain stiffness, a recording medium Sd of a different stiffness sometimes lands unstably on the pre-fixing guide 4*a* and diagonally gets into the fixing nip 4*n*. It causes a blur.

Therefore, height of the conveyance member 2 is changed according to conditions, such as physical properties of the recording medium S, by variable control of the controller 10. That is, the controller 10 controls position of the conveyance member 2 according to physical properties of the recording medium S fed to the fixing device 4 by the conveyance member 2. It stabilizes the point where the recording medium S lands on the pre-fixing guide 4*a*. The recording medium S is conveyed from the pre-fixing guide 4*a* along the fixing approach guide 4*b*, and smoothly gets into the fixing nip 4*n*. It maintains good image quality.

The following is an example of control of position of the conveyance member 2 by the controller 10.

Control Example 1

First, Control Example 1 will be described.

The controller 10 selects a height of the conveyance member 2 from H1-H3 based on difference in basis weight of the recording medium S, coverage of a formed image, and single/double-sided printing.

In terms of coverage, the stiffness increases by a thickness of toner. In double-sided printing, the stiffness is increased once the recording medium S passes through the fixing nip 1*n*. Since the stiffness changes as described above, the point where the recording medium S lands on the pre-fixing guide 4*a* varies. The controller 10 variably controls the conveyance member 2 according to conditions such that the conveyance member 2 is at an appropriate position. Thereby the controller 10 stabilizes the point where the recording medium S lands on the pre-fixing guide 4*a*.

FIG. 6 and FIG. 7 are tables of correspondence between conditions applied by the controller 10 and height of the conveyance member 2. In FIG. 6, basis weight, coverage, and side 1/2 are condition items. The side 1 represents printing on the first side. The side 2 represents printing on the second side in double-sided printing. In FIG. 7, bending stiffness detected by the stiffness detector 5*c* is applied as a condition instead of the basis weight. Others are the same condition items as those in FIG. 6.

The controller 10 selects a height of the conveyance member 2 from H1-H3 according to the correspondence table in FIG. 6 or FIG. 7. It stabilizes the point where the recording medium S lands on the pre-fixing guide 4*a*. The recording medium S is conveyed from the pre-fixing guide 4*a* along the fixing approach guide 4*b*, and smoothly gets into the fixing nip 4*n*. It maintains good image quality.

Control Example 2

Control Example 2 is performed in addition to Control Example 1.

Figures 8, 9:
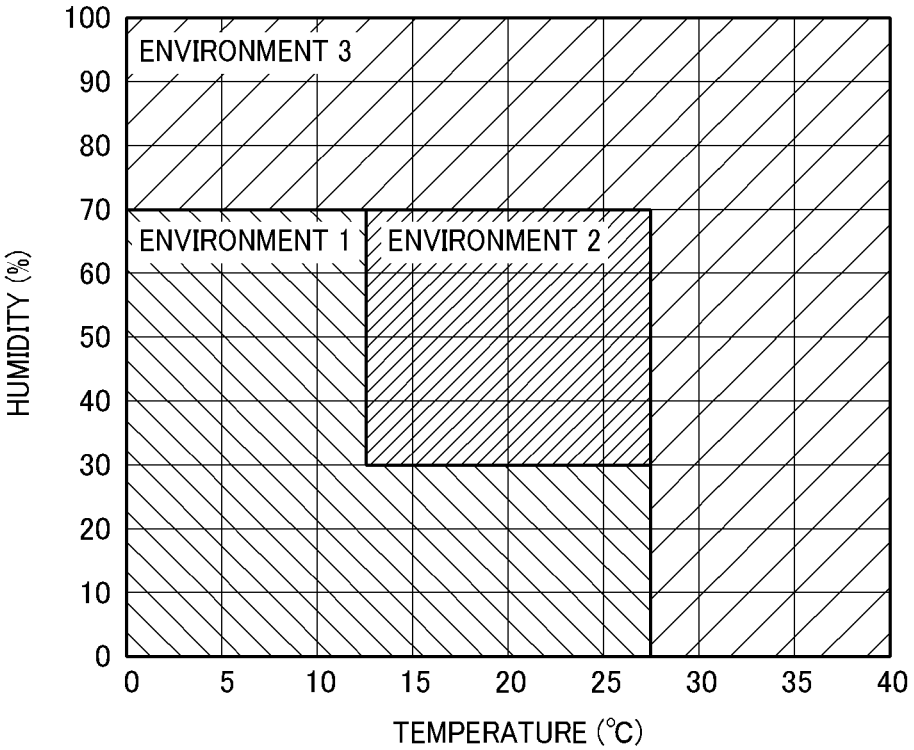
FIG. 8 is a two-dimensional graph of temperature and humidity. Environment is divided into three parts.
FIG. 9 is a table of correspondence between conditions applied by the controller and height of the conveyance member.

Since stiffness of the recording medium S varies depending on temperature and humidity, posture of the recording medium S getting into the fixing device 4 also varies. As shown in FIG. 8, an area on a two-dimensional graph of temperature and humidity is divided into three environments.

The controller 10 controls position of the conveyance member 2 as follows based on values detected by the temperature and humidity detector 6.

In a case where the temperature and humidity detected by the temperature and humidity detector 6 correspond to Environment 2, the controller 10 applies the correspondence table in FIG. 6 or FIG. 7. In a case where temperature and humidity correspond to Environment 1, the controller 10 applies a correspondence table in FIG. 9. In a case where temperature and humidity correspond to Environment 3, the controller 10 applies a correspondence table in FIG. 10. Thus, the controller 10 selects a height of the conveyance member 2.

The point where the recording medium S lands on the pre-fixing guide 4*a* is stabilized even if temperature and humidity change. The recording medium S is conveyed from the pre-fixing guide 4*a* along the fixing approach guide 4*b*, and smoothly gets into the fixing nip 4*n*. It maintains good image quality.

Control Example 3

Control example 3 will be described.

The controller 10 controls position of the conveyance member 2 based on values detected by the distance detector 7. Specifically, the larger the distance, the lower the position of the conveyance member 2 which is set by the controller 10. It stabilizes the point where the recording medium S lands on the pre-fixing guide 4*a*. The recording medium S is conveyed from the pre-fixing guide 4*a* along the fixing approach guide 4*b*, and smoothly gets into the fixing nip 4*n*. It maintains good image quality.

FIG. 11 shows a case where distances between the recording medium S and the conveyance belt B2 at both edges of the conveyance member 2 are substantially the same. The controller 10 moves up and down the conveyance member 2 in a state where the conveyance member 2 is parallel to the fixing nip 4*n*.

FIG. 12 shows a case where distances between the recording medium S and the conveyance belt B2 at both edges of the conveyance member 2 are different. The controller 10 individually controls position of each edge of the conveyance member in the width direction FR of the recording medium based on values detected by the distance detector 7. Specifically, the conveyance member 2 is tilted with respect to the fixing nip 4*n* and the height is appropriately controlled so that imbalance of positions of both edges with respect to the fixing nip 4*n* is reduced. In FIG. 12, one edge F is lower than another edge R. Even in a case where distances between the recording medium S and the conveyance belt B2 at right and left edges of the conveyance member 2 are different, the point where the recording medium S lands on the pre-fixing guide 4*a* is stabilized. The recording medium S is conveyed from the pre-fixing guide 4*a* along the fixing approach guide 4*b*, and smoothly gets into the fixing nip 4*n*. It maintains good image quality.

As described above, shape of the transfer nip to is maintained even if position of the conveyance member 2 changes. Transcription of an image to a recording medium does not change. Therefore, conveyance to the fixing device 4 is stabilized without changing transcription of an image to a recording medium. Good image quality is maintained.

The scope of the present invention is not limited to the above embodiment, and includes various modifications, omission, and combinations within the scope of the claims of the present invention.

In the above control for position, control values may be calculated based on values detected by detectors. Alternatively, a table showing relation between detected values and control values may be prepared in advance. A control value is determined by referring to the table based on a detected value.

Although embodiments of the present invention have been described and illustrated in detail, the disclosed embodiments are made for purposes of illustration and example only and not limitation. The scope of the present invention should be interpreted by terms of the appended claims.

The entire disclosure of Japanese patent application No. 2020-101954, filed on Jun. 12, 2020, is incorporated herein by reference in its entirety.

What is claimed is:

1. An image forming device, comprising:

an image carrier;

a transfer member that forms a transfer nip that transfers an image carried on the image carrier to a recording medium;

a fixing device that fixes the image on the recording medium;

a conveyance member which is located downstream of the transfer member in a conveyance direction of the recording medium and which feeds the recording medium to the fixing device, wherein the transfer member and the conveyance member share a conveyance belt; and a controller, wherein the controller individually controls a position of each edge of the conveyance member in a width direction of the recording medium which is orthogonal to the conveyance direction of the recording medium.

2. The image forming device according to claim 1, wherein the controller controls the position of the conveyance member according to physical properties of the recording medium fed to the fixing device by the conveyance member.

3. The image forming device according to claim 2, further comprising:

a physical property detector that detects the physical properties of the recording medium.

4. The image forming device according to claim 1, wherein displacement of the conveyance member caused by control of the controller includes a component perpendicular to a surface of the recording medium passing through the conveyance member.

5. The image forming device according to claim 1, further comprising:

a temperature and humidity detector that detects temperature and humidity, wherein the controller controls the position of the conveyance member based on values detected by the temperature and humidity detector.

6. The image forming device according to claim 1, further comprising:

a distance detector which is located upstream of the conveyance member and which detects a distance between the recording medium and the conveyance member, wherein the controller controls the position of the conveyance member based on values detected by the distance detector.

7. The image forming device according to claim 6, wherein the distance detector detects distances between the recording medium and the conveyance member at two or more different positions in the width direction of the recording medium which is orthogonal to the conveyance direction of the recording medium, and the controller individually controls position of each edge of the conveyance member in the width direction of the recording medium based on the values detected by the distance detector.

8. The image forming device according to claim 1, wherein the conveyance member is a rotating member.

* * * * *